US005798023A

United States Patent [19]

Pruszynski et al.

[11] Patent Number: 5,798,023

[45] Date of Patent: Aug. 25, 1998

[54] COMBINATION OF TALC-BENTONITE FOR DEPOSITION CONTROL IN PAPERMAKING PROCESSES

[75] Inventors: Przemyslaw Pruszynski; John R. Armstrong, both of Burlington, Canada

[73] Assignee: Nalco Chemical Company, Naperville, Ill.

[21] Appl. No.: 646,000

[22] Filed: May 14, 1996

[51] Int. Cl.[6] ..... D21H 21/02

[52] U.S. Cl. ..... 162/181.1; 162/181.6; 162/181.8; 162/183; 162/199; 162/164.1; 162/168.1; 162/175; 162/DIG. 4

[58] Field of Search ..... 162/181.8, 181.6, 162/DIG. 4, 199, 168.1, 183, 168.3, 168.2, 164.1, 175

[56] References Cited

U.S. PATENT DOCUMENTS

| | | | |
|---|---|---|---|
| 4,070,236 | 1/1978 | Carrard et al. | 162/168.1 |
| 4,388,150 | 6/1983 | Sunden et al. | 162/175 |
| 4,643,801 | 2/1987 | Johnson | 162/181.6 |
| 4,753,710 | 6/1988 | Langley et al. | 162/168.3 |
| 4,913,775 | 4/1990 | Langley et al. | 162/168.3 |
| 4,964,955 | 10/1990 | Lamar et al. | 162/DIG. 4 |
| 5,098,520 | 3/1992 | Begala | 162/168.2 |
| 5,368,692 | 11/1994 | Derrick | 162/DIG. 4 |
| 5,484,834 | 1/1996 | Chung | 162/168.1 |

FOREIGN PATENT DOCUMENTS

| | | |
|---|---|---|
| 1 150 914 | 8/1983 | Canada . |
| 1 194 254 | 10/1985 | Canada . |
| 0 621 369 A1 | 3/1994 | European Pat. Off. . |
| PCT/GB95/00231 | 2/1995 | WIPO . |
| PCT/GB95/00232 | 2/1995 | WIPO . |

OTHER PUBLICATIONS

Hassler, "Pitch Deposition in Papermaking and the Function of Pitch–Control Agents", Tappi Journal, Jun. 1988, pp. 195–201.

Retention Improvement in Difficult Furnishes—K. R. Stack/L. A. Dunn, APPITA Annual General Conference, 83–90, 1995.

Newsprint Papermachine Trials with Polyoxyethylene as a Wet–End Additive, R. H. Pelton, C.H. Tay, L.H. Allen, Journal of Pulp and Paper Science: Jan. 1984, J5–J11.

Crouzer, C., Marchal, J. Makromol. Chem. 166,99 (1973); 166, 155 (1973).

Effect of Eucalpyt Extractives on the Retention Performance of Polyethylene Oxide and Phenolformaldehyde Resin, K. R. Stack, L. A. Dunn, N. K. Roberts—Appita 45(3), 189–192 (1992).

The Use of Retention Aids in Newsprint Manufacture, A. Barnes, R. Coghill, D. Thurley, Appita, 42(5), 373–375 (1989).

Study of the Interaction Between Poly(Ethylene Oxide) and Phenol–Formaldehyde Resin, K. Stack, L. Dunn, N. Roberts, Colloids and Surfaces, 61 (1991) 205–218.

Mechanisms of Fines Retention by Polyethylene Oxide in Newsprint Furnishes, L. Rahmam, C. H. Tay, Tappi, 69/(4), 100–105, 1986.

Application of Polymeric Flocculant in Newsprint Stock Systems for Fines Retention Improvement, C. H. Tay, Tappi, vol. 63, No. 6, 63–66, 1980.

Newsprint Mill Experience with Wet End Double Polymer Addition for Retention Improvement, S. Shastri, Papermakers Conference, 205–210, 1983.

Novel Water Soluble Polymers as Flocculants, Huining Xiao, McMaster University, Dec. 1994.

Evaluation of Various Phenolformaldehyde Resins in the Phenolformaldehyde Resin—Polyethyleneoxide Dual Retention Aid System, Journal of Wood Chemistry and Technology, 13(2), 283–308 (1993).

*Primary Examiner*—Peter Chin

*Attorney, Agent, or Firm*—Thomas M. Breininger; Elaine M. Ramesh

[57] ABSTRACT

A method for minimizing pitch, ink, and stickies particle deposits in the paper making process by causing the retention of such particles onto fiber, comprising the steps of adding an effective pitch, ink, and stickies controlling amount of talc to a suspension of fiber in contact with the paper machine and associated parts and adding an effective pitch, ink, and stickies controlling amount of bentonite to the suspension, thereby increasing retention of pitch, ink, and stickies onto the fiber and minimizing the deposition of pitch, ink, and stickies particles on the paper machine and associated parts.

14 Claims, No Drawings

COMBINATION OF TALC-BENTONITE FOR DEPOSITION CONTROL IN PAPERMAKING PROCESSES

FIELD OF THE INVENTION

A method for minimizing pitch, ink, and stickies particle deposition in the paper making process comprising the steps of adding an effective pitch, ink, and stickies controlling amount of talc and bentonite to the fiber suspension and adding an effective pitch, ink, and stickies controlling amount of bentonite to the suspension, thereby reducing the pitch, ink, and stickies particle deposition in the paper making process.

BACKGROUND OF THE INVENTION

The problem of pitch, ink, stickies particle deposition control in the paper making process for all types of paper has previously been recognized. The pitch in the fibers of wood pulps is associated with naturally occurring lignin dispersing agents. Cooking and mechanical agitation which occur during the pulping by the sulfate process liberate pitch and these natural dispersing agents. However, as a result of the mechanical work on the fibers, the natural dispersing agents liberated along with the pitch are inadequate to keep the pitch from depositing on the equipment employed in beating, hydrating, refining, bleaching, and even on the wire used for forming the sheet.

Because of the tendency of the pitch to agglomerate within the pulp suspension or deposit on the surfaces of the wire or other equipment, the pitch frequently causes the formation of spots or holes in the sheet formed. Additionally, the pitch may adhere to the wire or press rolls or dryer rolls and cause tearing of the sheet. The result of the pitch contamination is the production of sheets with numerous imperfections. Among other consequences of pitch particle deposition are the expense of cleaning the machinery frequently either with solvents or steam, and the loss of production during cleaning and replacing operations caused by breakdown of the sheet.

Organic contaminants, such as ink and adhesives which are present in recycled paper, can have a sticky or tacky nature. The problems of handling such contaminants, referred to as ink and stickies, is similar to the problems encountered with pitch.

Water soluble polymers, and in particular, cationic water soluble polymers, have been used in the production of paper for a number of purposes. Water soluble polymers have been added to pulps to improve fine and filler retention. In another instance, these polymers have been used to improve drainage of water from the pulp as it is formed into a sheet on wires or felts. Polymers have also been used to attach pitch particles to cellulose fibers while they were in a colloidal state thereby preventing them from agglomerating and accumulating on the surfaces of production equipment. Polymers also have been used for improved efficiency in retaining fillers, such as clays.

In the case of cationic polymeric coagulants, it is necessary to combine them with flocculants to make their performance acceptable. Examples of cationic polymers used for pitch retention, see Canadian Patent Applications, 1,150,914 and 1,194,254, the disclosures of which are incorporated herein by reference. These applications disclose cationic polymers which give superior colloidal pitch particle reduction in aqueous pulps such as polyquatemary polymers of essentially linear structure consisting of essentially of a diflnctional reaction product of a lower dialkylamine and a diftinctional epoxy compound selected from the group consisting of epihalohydrins, diepoxide, precurors of epihalohydrins and diepoxides, and poly-diallyldimethyl ammonium chloride, respectively. See also U.S. Pat. No. 5,098,520 and allowed U.S. patent application Ser. No. 08/148,069, the disclosure of which is incorporated herein by reference.

Previous products used for this purpose have included low molecular weight polymers of DADMAC, epichlorohydrin diamine polymers or other polyamines including polyethyleneimine. Due to the low molecular weight, these products were often less effective as retention aids and in some cases had to be supplemented with a high molecular weight flocculant to achieve their desired level of retention. Flocculants by themselves failed to give adequate retention of colloidal materials, often hurting machine runability.

The paper making process, particularly the production of newsprint, presents a challenge to the paper maker with respect to optimizing production. It is increasingly common to use recycled fiber rather than virgin fiber in newsprint furnish. Due to the nature of newsprint and the necessity to carefully control costs, problems such as retention, drainage and pitch, ink, and stickies particle deposition control must be solved economically. It would represent an advance in the art if newsprint mills, as well as other paper mills, could use one product which could solve or improve the several problems described above.

In recent years, the use of retention programs using inorganic "microparticles" has gained acceptance. Microparticle programs are defined not only by the use of a microparticle component but also by the addition points of chemicals in relation to shear. In order to be effective, conventional retention and drainage programs require incorporation of some higher molecular weight component as part of the program. In conventional programs, the high molecular weight component is added after a high shear point in the stock flow system leading up to the headbox of the paper machine. Flocs that are formed by addition of the high molecular weight component are broken down to some extent by the high shear. Since these flocs are formed primarily by the bridging mechanism, this breakdown is largely irreversible and flocs do not re-form to any significant extent. For this reason, most of the retention and drainage performance of the flocculant is lost by feeding it before a high shear point. Additionally, a need for feeding the high molecular weight polymer after the high shear point often leads to formation problems. The feeding requirements of the high molecular weight polymers and copolymers which provides improved retention often leads to a compromise in formation.

In the microparticle retention programs, high molecular weight polymer is added before at least one high shear point. An inorganic, particulate material is then added to the furnish after the stock has been flocculated with the high molecular weight component and subjected to shear. The microparticle, usually highly negatively charged, is added to a furnish pretreated with some cationic material [e.g., starch, coagulant, alum, cationic flocculant] so that the primary mechanism of operation appears to be an electrostatic interaction. The microparticle addition re-flocculates the furnish, resulting in retention and drainage that is at least as good as that attained using the high molecular weight component in the conventional way (after shear), with no deterious impact on formation.

One such program employed to provide an improved combination of retention and dewatering is described in U.S.

Pat. Nos. 4,753,710 and 4,913,775, inventors Langley et al., issued respectively Jun. 28, 1988 and Apr. 3, 1990, incorporated hereunto by reference. In the disclosed method, a high molecular weight linear cationic polymer is added to the aqueous cellulosic paper making suspension before shear is applied to the suspension, followed by the addition of bentonite after the shear application. Shearing is generally provided by one or more of the cleaning, mixing and pumping stages of the paper making process, and the shearing breaks down the large flocs formed by the high molecular weight polymer into microflocs, and further agglomeration then ensues with the addition of the bentonite clay particles.

The treatment of an aqueous cellulosic slurry with a high molecular weight cationic polymer followed by shear, preferably a high degree of shear, is a wet-end treatment in itself known in the field, for instance as described in aforesaid U.S. Pat. Nos. 4,753,710 and 4,913,775, inventor Langley et al., issued respectively Jun. 28, 1988, and Apr. 3, 1990, incorporated herein by reference.

Other such programs are based on the use of colloidal silica as a microparticle in combination with cationic starch (Sunden et al., U.S. Pat. No. 4,388,150 issued on Jun. 14, 1983) known as Composil (Eka Nobel) or cationic starch and flocculant combination (Johnson, U.S. Pat. No. 4,643,801 issued on Feb. 17, 1987) and known as Positek (Nalco). Since the onset of the microparticle-based technology, a number of other, synthetic organic microparticles have been developed and introduced to the market.

Talc and bentonite are widely used in the paper industry. Talc is primarily used as a pitch control agent and more recently for stickies control in recycled fibre. Bentonite is often used as part of a retention program. Using the two components together in dry form or as a slurry prior to delivery to the mill offers several advantages from both a performance and a handling points of view.

The present invention is predicated upon the discovery that talc used in combination with bentonite is capable of improving pitch, ink, and stickies particle retention to the fiber, thereby minimizing the deposition of pitch, ink, and stickies particles on the surfaces of the paper machine and associated parts (structures) which include, felts, pipes, wires, pumps, tanks, and the like in the production of all types of paper.

SUMMARY OF THE INVENTION

The invention is a method for minimizing pitch, ink, and stickies deposition in the paper making process by causing the retention of such particles onto fiber, comprising the steps of adding an effective pitch, ink, and stickies controlling amount of talc to a suspension of fiber in contact with the paper machine and associated parts and adding an effective pitch, ink, and stickies controlling amount of bentonite to the suspension in contact with the paper machine and associated parts, thereby increasing retention of pitch, ink, and stickies onto the fiber and minimizing pitch, ink, and stickies particles deposition on the paper machine and associated parts.

The bentonite and talc may be added to the separately to the paper making suspension in any order of addition. Additionally, the bentonite and the talc may also be added simultaneously to the suspension in contact with the paper machine and associated parts. The ratio of bentonite to talc is preferably from about 1:1 to about 0.1:20, more preferably from about 1:1 to 0.1:10, and most preferably from about 1:1 to 1:5.

DESCRIPTION OF THE INVENTION

The invention comprises a method for improving the paper making process, particularly the production of newsprint, filled newsprint, coated paper, all grades containing mechanical pulp, board paper, by improving the pitch and stickies control in the pulp and paper making process. The pitch, ink, stickies formation and deposits are minimized and in some cases eliminated. Specifically, it comprises adding an effective pitch, ink, and stickies controlling amount of bentonite having a high swelling capacity in water to a suspension of fiber in contact with the paper machine and associated parts, and then, an effective pitch, ink, and stickies controlling amount of talc is also added to the suspension in contact with the paper machine and associated parts, thereby increasing retention of pitch, ink, and stickies onto the fiber and minimizing the deposition of pitch, ink, and stickies particles on the paper machine and associated parts.

Bentonite is a colloidal clay, commercially available, composed predominantly of montmorillonite. The Wyoming or Western variety of bentonite is a sodium bentonite which has a high water swelling capacity. The Southern variety is a calcium bentonite with negligible swelling capacity. The bentonite can be any of the materials commercially referred to as bentonites or bentonite-type clays. Preferably, the bentonite is of the type having a high swelling capacity in water, such as sodium potassium bentonite. Bentonite clay has the desirable property of being thixo-tropic and shear thinning, i.e., it forms a network which is easily destroyed by the application of shear, but then reforms when shear is removed.

The dry particle size of the bentonite is preferably at least 90% below 100 microns and most preferably at least 60% below 50 microns. The surface area of the bentonite particles before swelling is preferably at least 30 and more preferably at least 50, and most preferably between 60 to 90 $m^2/gm$. The surface area after swelling is preferably between 400 and 800 $m^2/gm$. The preferred type of the bentonite swells at least 15 or 20 times. The particle size after swelling is preferably at least 90% below 2 microns.

Talc, an inexpensive material, commercially available, which is commonly used for pitch, ink and stickies deposition control in pulp and paper mills, is a crystalline powder of a natural hydrous magnesium silicate. The crystallographic structure of talc results in a platelet-like appearance. The edges of these platelets are hydrophilic, and as such is responsible for the dispersability of talc in water. The hydrophobic faces of the platelets are able to interact with hydrophobic substances, such as pitch and stickies particles.

Colloidal pitch adsorbs onto the hydrophobic faces of the talc crystal, thereby preventing the formation of large pitch agglomerates. "Detackification", a changing of the surface properties of pitch and stickies particles, is recognized as the operating mechanism of talc. The talc/pitch particles are retained in the fiber mat as its forms, thereby preventing the recirculation, concentration and eventual deposition of these particles in the system.

However, the exposure of the talc/pitch agglomerate to shear will often create a fresh, sticky surface which can cause deposit problems further on in the paper making process. Other disadvantages to using talc include the high talc dosage rates often required to give good pitch, ink, and stickies deposition control and its abrasiveness which decreases the useful life of paper machine components such as wires, pick-up rolls and felts. At the high dosages of talc, a very effective retention program must be in place or wire and felt plugging in the press section of a paper machine will occur. However, high dosages of talc can also increase the slipperiness of the sheet formed, resulting in problems during the process of winding and in the printing presses. At low dosages of talc, the deposition of pitch and stickies particles possible as well as the talc itself becoming a part of the deposit thereby increasing the mass of deposit formed during the paper making process.

The use of talc in combination with bentonite (or bentonite and a treatment polymer used to improve the retention capacity in a furnish) allows a reduction in the dosage of talc while producing an effective pitch and stickies control program and avoiding the disadvantages of high talc dosage rates such as felt plugging and slipperiness problems. Bentonite increases the retention of talc particles. Complete retention of pitch and stickies particles in the formed web of paper is most likely not possible. Therefore, the addition of a small amount of talc in combination with bentonite or a bentonite/treatment polymer program will allow detackification of the remaining unretained pitch particles.

The term "paper machine", as used herein, includes felts, pumps, wires, tanks, pipes, and similar associated parts as well as all metal surfaces where the fiber suspension contacts the surface of the paper machine. The term "suspension" as used herein includes pulp, fiber suspended in water, furnishes and the like.

The talc may be added to the suspension before the bentonite is added to the suspension. In another embodiment, the bentonite and the talc may be added simultaneously to the suspension in contact with the paper machine and associated parts. In addition, the bentonite and talc may be added as a mixture. The bentonite and talc can be mixed together in the powdered form. This may be done on-site, but likely off-site at the point where one or the other is mined or manufactured. Bentonite and talc have similar requirements for preparing a slurry of either in terms of mixing. Preparing a slurry of the mixture will therefore require less equipment and also make feeding and metering easier, making the invention easier to practice.

The ratio of bentonite to talc is preferably from about 1:1 to 0.1:20, more preferably from 1:1 to 0.1:10, and most preferably from about 1:1 to 1:5.

The talc/bentonite treatment program may be added to paper making systems to improve pitch, ink, and stickies control. This talc/bentonite treatment program is also effective in treating newsprint made from either virgin or recycled fibers. It is understood that the term, "newsprint" as used herein includes other grades of paper which contain mechanical pulp, recycled or deinked pulp.

The talc and bentonite are added to the pulp slurry (suspension). Both bentonite and talc, added separately or as a mixture, can be fed at any point to the paper making process or suspension, at any point in the paper machine. In addition, the bentonite and talc, added separately or as a mixture, can be added as a dry powder or as a hydrated suspension obtained by dispersing powdered material in water.

Since both bentonite and talc require hydration prior to injection into the paper making system, delivering them to the site as a mixture and hydrating the mixture in the same tank is advantageous in reducing the amount of mechanical equipment required to perform the hydration.

Dosages of Bentonite and Talc

| Bentonite | Talc |
|---|---|
| 0.05–10 | 0.05–20 |
| 0.1–5 | 0.5–10 |
| 0.5–3 | 1–5 |

The invention can be used in the presence of any effective retention program applied in the mill. An effective retention program is required to provide retention of talc, which if unretained could cause felt plugging problem. It would be preferable to use the invention in the presence of a retention program wherein the retention of the talc would be benefited. A wide variety of chemistries are known in the art to work as retention agents, including polymeric materials. Examples of the polymeric material that can be used as a retention program include acrylamide homopolymers, copolymers, terpolymers, and so on.

The polymers useful in the practicing of this invention contain at least one of the monomers chosen from the group consisting of acrylamide, methacrylamide, N-tertiary butyl acrylamide, 2-acrylamido-2-methylpropane sulfonate, sulfomethyl acrylamide, sulfomethyl methacrylamide, sulfoethylacrylamide, and the like. In addition, the polymeric retention material may also be the diftinctional reaction product of a lower dialkylamine and a difunctional epoxy compound selected from the group consisting of epihalohydrins, diepoxide, precurors of epihalohydrins and diepoxides, as well as poly-diallyldimethyl ammonium chloride.

The polymers used in the application of this invention are generally selected from, however, not limited to, following examples. These polymers belong to one of the three classes: nonionic, anionic and cationic. The nonionic polymers are homopolymers or copolymers of nonionic monomers. The preferred nonionic monomer is acrylamide or methacrylamide and preferred nonionic polymers are polyacrylamide and polymethacrylamide.

By the term of cationic retention polymers, it is understood to include any water-soluble copolymer of (meth) acrylamide which carries or is capable of carrying the cationic charge when dissolved in water, whether or not this charge-carrying capacity is dependent upon pH. The cationic copolymers of (meth)acrylamide include the following examples which are not meant to be limiting on this invention: copolymers of (meth)acrylamide with dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate or methyl chloride. Mannich reaction modified polyacrylamides, diallylcyclohexylamine hydrochloride (DACHA HCl), diallyldimethylammonium chloride (DADMAC), methacrylamidopropyltrimethylammonium chloride (MAPTAC) and allyl amine (ALA).

The high molecular weight anionic polymers are preferably water-soluble vinyl copolymers of (meth)acrylamide with following monomers: acrylic acid, 2-acrylamido-2-methylpropane sulfonate (AMPS) and mixture thereof. The anionic high molecular weight (co)polymers may also be either hydrolyzed acrylamide polymers or copolymers of acrylamide or its homologues, such as methacrylamide, with acrylic acid or its homologues, such as methacrylic acid, or with monomers, such as maleic acid, itaconic acid, vinyl sulfonic acid, AMPS, or other sulfonate containing monomers.

The anionic polymers may be sulfonate or phosphonate containing polymers which have been synthesized by modifying acrylamide polymers in such a way as to obtain sulfonate or phosphonate substitutions, or mixtures thereof. The most preferred high molecular weight anionic retention polymers are acrylic acid/acrylamide copolymers, and sulfonate containing polymers such as 2-acrylamide-2-methylpropane sulfonate/acrylamide copolymer (AMPS), acrylamido methane sulfonate acrylamide (AMS), acrylamido ethane sulfonate/acrylamide (AES) and 2-hydroxy-3-acrylamide propane sulfonate/acrylamide (HAPS).

It is preferred that nonionic, cationic and anionic polymers have a molecular weight of at least about 500,000 to about 30,000,000. A more preferred molecular weight is at least about 1,000,000 to about 30,000,000 with the best results observed when molecular weight is between about 5,000,000 to about 30,000,000. The anionic or cationic monomer may constitute up to about 80 mole % of the copolymer, with best results observed the range of about 0 to about 30 mole % of an anionic or a cationic charge.

The invention can be used in the presence of any effective flocculation program applied in the mill. In a single polymer program, a flocculant, typically a cationic polymer, is the only material added. Another method of improving the flocculation of cellulosic fines, mineral fillers and other furnish components on the fiber mat is the dual polymer program, also referred to as a coagulant/flocculant system, added ahead of the paper machine.

In such a system there is first added a coagulant, for instance a low molecular weight synthetic cationic polymer or cationic starch to the furnish, which coagulant generally reduces the negative surface charges present on the particles in the furnish, particularly cellulosic fines and mineral fillers, and thereby accomplishes a degree of agglomeration of such particles, followed by the addition of a flocculant. Such flocculant generally is a high molecular weight synthetic polymer which bridges the particles and/or agglomerates, from one surface to another, binding the particles into larger agglomerates. The presence of such large agglomerates in the furnish as the fiber mat of the paper sheet is being formed increases retention. The agglomerates are filtered out of the water onto the fiber web, whereas unagglomerated particles would to a great extent pass through such paper web.

Coagulant is typically a cationic polymer having a low molecular weight of at least about 1,000 and less than about 500,000. More preferably, the molecular weights range from about 2,000 to about 200,000.

Examples of polymers used as coagulants include copolymers of diallyldimethylammonium chloride and monomers selected from the group consisting of quaternized dimethylaminoethylacryaltes, quaternized dimethylaminomethacrylates, vinyltrimethoxysilane, acrylamide, diallyldimethylaminoalkyl(meth)acrylate, diallyldimethylaminoalkyl(meth)acrylamide and mixtures thereof. In addition, polymers that can be used include polyethylene imines, polyamines, polycyandiamide formaldehydes, diallyldimethylammonium chlorides, diallyldimethylaminoalkyl(meth)acrylates, diallyldimethylaminoalkyl(meth)acrylamides, polymethylamine epichlorohydrins as well as co-polymers of acrylamide and/or diallyldimethylaminoalkyl(meth)acrylates and diallyldimethylaminoalkyl(meth)acrylamides or co-polymers of ammonium ethylene dichorides or acrylamido N,N-dimethyl piperazine quaternary acrylamides.

Polymers applicable to this invention may also include vinylamine polymers containing at least one monomer selected from the group consisting of amidine vinylformamide, vinyl alcohol, vinyl acetate, vinyl pyrrolidinone and the esters, amides, nitrites and salts of acrylic acid and methacrylic acid.

Paper or paper board is generally made from a suspension or slurry of cellulosic material in an aqueous medium, which slurry is subjected to one or more shear stages, in which such stages generally are a cleaning stage, a mixing stage and a pumping stage, and thereafter the suspension is drained to form a sheet, which sheet is then dried to the desired, and generally low, water concentration.

Microparticle retention programs are based on the effect of restoration of the originally formed flocs which are then sheared. In such applications, the flocculant is added before at least one high shear point, followed by the addition of microparticle just before the headbox. Typically, a flocculant will be added before the pressure screens, followed by the addition of microparticle after the screens. Secondary flocs formed by the addition of microparticles result in increased retention and drainage without detrimentally affecting formation of the sheet. This allows increased filler content in the sheet, eliminates two-sidedness of the sheet, and increases drainage and speed of the machine in paper manufacturing. A number of substances are used as microparticles, but the best known are bentonite and colloidal silica.

The use of the excess amount of polymeric flocculant or coagulant is believed necessary to ensure that the subsequent shearing results in the formation of microflocs which contain or carry sufficient polymer to render at least parts of their surfaces positively charged, although it is not necessary to render the whole slurry positively charged. Thus the Zeta potential of the slurry, after the addition of the acrylamide copolymer and after the shear stage, may be cationic or anionic.

Shear may be provided by a device in the apparatus used for other purposes, such as a mixing pump, fan pump or centriscreen, or one may insert into the apparatus a shear mixer or other shear stage for the purpose of providing shear, and preferably a high degree of shear, subsequent to the addition of the copolymer.

Another embodiment of the invention is a method for minimizing pitch, ink, and stickie particle deposits in the paper making process by causing retention of such particles onto fiber comprising the steps of:

a) adding to a suspension in contact with a paper machine and associated parts from about 0.005 to about 0.5% by weight based on fiber in suspension of a flocculant;

b) subjecting the suspension to at least one shear stage; and c) adding to the suspension from about 0.005 to about 0.5% by weight based on fiber in suspension of a mixture of bentonite and talc, thereby increasing retention of pitch, ink, and stickies onto the fiber and minimizing the deposition of pitch, ink, and stickies particles on the paper machine and associated parts.

The suspension may be selected from the group consisting of fine paper, board, and grades made from mechanical pulps. The flocculent may be selected from the group consisting of cationic, nonionic, and anionic polymeric flocculants.

In one embodiment of the invention, the talc may be added to the suspension before the bentonite is added to the suspension. In an alternative embodiment of the invention, the talc and the bentonite may be added simultaneously or as a mixture to the suspension in contact with the paper machine and associated parts.

The ratio of the talc to the bentonite is preferrably from about 0.1 to about 5. From about 0.05 to about 20 kilograms of the talc per ton of fiber in suspension may be added to the suspension in contact with the paper machine and associated parts. In addition, from about 0.05 to about 10 kilograms of the bentonite per ton of fiber in suspension may be added to the suspension in contact with the paper machine and associated parts.

Mixtures of bentonite and talc provide several advantages. Retention is enhanced when the combination of talc/bentonite is used. Residual, unretained, pitch in the systen is also less sticky (detackified) and therefore, exhibits lower propensity for deposition. Any deposits that may be formed tend to be less sticky and can be more easily removed. Feeding bentonite and talc as a mixture allows for a more controlled dosage. Brightness resulting from the combination is higher than the brightness obtained with bentonite alone. Talc is known to cause a slippery sheet at higher dosages, resulting in press room runnability problems. By using a mixture of talc and bentonite, the talc dosage can be reduced, thereby, reducing the problems at the winding stage with crepe wrinkles and fewer problems in the printing press rooms from slippery paper.

In addition, use of the talc/bentonite mixture as a microparticle where the mixture is fed after the use of a high molecular weight polymer provides improvement in formation as well as retention.

BENTONITE AND TALC TREATMENT LEVELS

The amounts of bentonite and talc which has been found effective ranges from a concentration of approximately 0.05 kilograms of bentonite and 0.05 kilograms of talc per ton of pulp solids up to and including about 10 kilograms of bentonite and 20 kilograms of talc per ton of pulp solids.

Preferably, treatment levels range between about 0.1 kilograms of bentonite and 0.5 kilograms of talc per ton total pulp solids to about 5 kilograms of bentonite and 10 kilograms of talc per ton of pulp solids. Most preferably, the effective treatment ranges are between about 0.5 kilograms of bentonite and 1 kilogram of talc per ton of pulp solids to about 3 kilograms of bentonite and 5 kilograms of talc per ton of pulp solids, although each source of newsprint pulp can and does have its own character and the treatment level demand. In cases where talc is also added to the system as a filler, the dosages of talc may be higher than the dosages given here.

EVALUATION OF THE INVENTION

The following examples are presented to describe preferred embodiments and utilities of the invention and are not meant to limit the invention unless otherwise stated in the claims appended hereto.

EXAMPLE

To test the amount of pitch, ink, and stickies particle deposition in paper making systems treated with the compositions of the instant invention, a coupon test was employed. A 500 ml sample of dry lap kraft pulp from the mill is obtained. 100 ml of a 1% synthetic pitch solution in isopropanol is added to the pulp sample. The sample is stirred with a spatula and the pH is adjusted to 6.2–6.3 with concentrated HCl. The pulp mixture is then stirred in a blender. 5 ml of an 0.5 M $CaCl_2$ 2 $H_2O$ solution is added to the stirred pulp mixture. Treating agents to be evaluated are added next. A pre-weighed Teflon coupon is suspended in the stirred pulp mixture. After a pre-determined length of time, the coupon is removed and rinsed with water. The coupon is oven dried, and subsequently weighed to determine the amount of deposition. A decrease in percent deposition above the value obtained for the blank experiment indicates that the treatment inhibits deposition.

TABLE 1

| treatment | dosage (kg/ton) | % Deposition | % Improvement related to blank |
|---|---|---|---|
| talc | 3 | 30.7 | −58 |
| bentonite/talc | 3 | 4.1 | 65 |
| bentonite/talc/ treatment polymer | 3/3/1 | 1.5 | 87 |
| polymeric coagulant/bentonite/talc/ treatment polymer | 0.5/3/3/1 | 2.1 | 82 |

As can be seen in Table 1, talc added alone at a low dosage increases the amount of deposition. In combination with other component programs, low dosages of talc result in decrease of deposition. Such programs provided improved control of residual unretained pitch and the talc was less tacky and less prone to deposition on the different elements of the paper machine. In addition, the combination of bentonite and talc provide a wider spectrum of applications as bentonite and talc each have an affinity to a different fraction of pitch and stickies particles. Polymer used in this example is the dadmac-polyacrylamide copolymer with RSV=6 and charge density of 1mEq/g.

Changes can be made in the composition, operation and arrangement of the method of the present invention described herein without departing from the concept and scope of the invention as defined in the following claims:

We claim:

1. A method for minimizing pitch, ink and stickies particle deposits in the paper making process by causing retention of such particles onto fiber comprising the steps of:

a) adding an effective pitch, ink and stickies controlling amount of bentonite having a high swellable capacity in water to a suspension of fiber in contact with the paper machine and associated parts; and then, b) adding from about 0.05 to about 20 kilograms of the talc per ton of fiber in suspension to the suspension in contact with the paper machine and associated parts, wherein the ratio of bentonite to talc is from about 1:1 to about 0.1:20, thereby increasing retention of pitch, ink and stickies onto the fiber and minimizing the deposition of pitch, ink, and stickies particles on the paper machine and associated parts.

2. The method of claim 1, wherein the bentonite and the talc are added simultaneously to the suspension in contact with the paper machine and associated parts.

3. The method of claim 2, wherein the bentonite and the talc are added as a mixture to the suspension in contact with the paper machine and associated parts.

4. The method of claim 1, wherein the talc is added to the suspension before the bentonite is added to the suspension.

5. The method of claim 1, wherein from about 0.05 to about 10 kilograms of the bentonite per ton of fiber in suspension is added to the suspension in contact with the paper machine and associated parts.

6. The method of claim 4, wherein from about 0.05 to about 10 kilograms of the bentonite per ton of fiber in suspension is added to the suspension in contact with the paper machine and associated parts.

7. A method for minimizing pitch, ink, and stickies particle deposits in the paper making process by causing retention of such particles onto fiber comprising the steps of:

a) adding to a suspension in contact with a paper machine and associated parts from about 0.005% to about 0.5% by weight based on fiber in suspension of a flocculent;

b) subjecting the suspension to at least one shear stage; and c) adding to the suspension from about 0.005to about 0.5% by weight based on fiber in suspension of a mixture of bentonite and talc, wherein from about 0.05 to about 20 kilograms of the talc per ton of fiber in suspension is added to the suspension in contact with the paper machine and associated parts, thereby increasing retention of pitch, ink, and stickies onto the fiber and minimizing the deposition of pitch, ink, and stickies particles on the paper machine and associated parts.

8. The method according to claim 7, wherein the suspension is selected from the group consisting of fine paper, board, and grades made from mechanical pulps.

9. The method according to claim 7, wherein the flocculant is selected from the group consisting of cationic, nonionic, and anionic polymeric flocculants.

10. The method according to claim 7, wherein the talc is added to the suspension before the bentonite is added to the suspension.

11. The method according to claim 7, wherein the talc and the bentonite are added simultaneously to the suspension in contact with the paper machine and associated parts.

12. The method of claim 11, wherein the bentonite and the talc are added as a mixture to the suspension in contact with the paper machine and associated parts.

13. The method according to claim 7, wherein the ratio of the talc to the bentonite is from about 0.1 to about 5.

14. The method according to claim 7, wherein from about 0.05 to about 10 kilograms of the bentonite per ton of fiber in suspension is added to the suspension in contact with the paper machine and associated parts.

* * * * *